US009814301B2

(12) United States Patent
Lee

(10) Patent No.: US 9,814,301 B2
(45) Date of Patent: Nov. 14, 2017

(54) PORTABLE INTERDENTAL TOOTHBRUSH

(71) Applicant: Sang Geun Lee, Gwangju-si (KR)

(72) Inventor: Sang Geun Lee, Gwangju-si (KR)

( * ) Notice: Subject to any disclaimer, the term of this patent is extended or adjusted under 35 U.S.C. 154(b) by 0 days.

(21) Appl. No.: 14/905,809

(22) PCT Filed: Apr. 13, 2015

(86) PCT No.: PCT/KR2015/003677

§ 371 (c)(1),
(2) Date: Jan. 17, 2016

(87) PCT Pub. No.: WO2015/126229

PCT Pub. Date: Aug. 27, 2015

(65) Prior Publication Data

US 2017/0224099 A1 Aug. 10, 2017

(30) Foreign Application Priority Data

Feb. 24, 2014 (KR) ..... 10-2014-0021350

(51) Int. Cl.
*A46B 11/04* (2006.01)
*A46B 11/00* (2006.01)

(52) U.S. Cl.
CPC ..... *A46B 11/0041* (2013.01); *A46B 11/0013* (2013.01); *A46B 11/0086* (2013.01); *A46B 2200/108* (2013.01)

(58) Field of Classification Search
CPC ..... A46B 2200/108; A46B 11/0013; A46B 11/0041
USPC ..... 401/270, 279
See application file for complete search history.

(56) References Cited

U.S. PATENT DOCUMENTS 9,216,072 B2 * 12/2015 Joyashiki ..... A61C 15/00
9,629,449 B2 * 4/2017 Lee ..... A61C 15/00

FOREIGN PATENT DOCUMENTS

| | | |
|---|---|---|
| KR | 20-0246271 | 10/2001 |
| KR | 10-2004-0008970 | 1/2004 |
| KR | 10-0468075 | 1/2005 |
| KR | 20-2012-0007150 | 10/2012 |
| KR | 20-0465554 | 2/2013 |

OTHER PUBLICATIONS

English Translation of 10-2004-0008970.
English Translation of 20-0246271.
English Translation of 20-2012-0007150.
English Translation of 20-0465554.
English Translation of 10-0468075.

* cited by examiner

*Primary Examiner* — Jennifer C Chiang
(74) *Attorney, Agent, or Firm* — KORUS Patent, LLC; Seong Il Jeong

(57) ABSTRACT

A portable interdental toothbrush is provided that can be carried conveniently since a cleaning solution tube stays in a sealed state when carried without using it, which makes it convenient to use. When using the interdental toothbrush, an engaging protrusion fixed to an engaging portion is released to wet a brush with the cleaning solution filled in the cleaning solution tube through the discharge hole by pulling the brush body. Due to the features, the structure is simple, the production is easy, and production cost is low, thereby allowing any user to use it, and promoting the dental and oral health for citizens.

4 Claims, 5 Drawing Sheets

PORTABLE INTERDENTAL TOOTHBRUSH

CROSS-REFERENCE TO RELATED APPLICATION(S)

This application claims the benefit of International Application No. PCT/KR2015/003677, filed on Apr. 13, 2015, based on Korean Patent Application No. 10-2014-0021350, filed on Feb. 24, 2014, the disclosure of which is hereby incorporated by reference in its entirety.

BACKGROUND

1. Technical Field

The present invention relates to a portable interdental toothbrush and is more particularly concerned with a portable interdental toothbrush in which a user can carry for portable use during travel or outing so as to clean and sterilize foreign materials and plaque that fit between teeth after meals; a cleaning solution tube for easily supplying a cleaning solution to the toothbrush in a state of carrying the interdental toothbrush is detachably attached, the cleaning solution is supplied to the interdental toothbrush via the cleaning solution tube, it is possible to separate the cleaning solution tube, replenish the cleaning solution and attach it again; its use is convenient, the structure becomes simple, and manufacturing cost is low.

2. Description of the Related Art

In general, the interdental toothbrush has small brush-shaped bristles for cleaning spaces between the teeth mounted on the end of the handle. They are orally hygiene instruments used to clean the oral cavity by washing interdental spaces using putting in and pulling out motions of the brush in the interdental space gaps. Use of the interdental toothbrush facilitates removal of food-residue and plaque of hard-to-reach areas of usual toothbrushes, sterilization after dental treatment such as scaling, prevention of plaque after smoking, and cleaning of orthodontic instruments such as, braces to maintain oral hygiene.

However, looking at the actual state of use of the current interdental brush, there at problems that the cleaning is conducted only using the brush and thus gums become stimulated, bleeding occurs frequently and the ability to remove food-residue and plaque becomes insufficient. Further, if interdental brushes are continuously used, there is an unpleasant smell from the brush due to a bad cleanliness, particularly, the growth of bacteria.

In an attempt to solve the above-mentioned problems, as shown in FIG. 1, there has been developed a toothbrush in which a lid 120 containing a cleaning solution 140 is coupled inside the toothbrush 110 coupled with bristles 130, and each time the user uses it, the toothbrush 110 is immersed in the cleaning solution so that the toothbrush 110 is soaked with the cleaning solution 130. However, this method has disadvantages in that the cleaning solution 140 is stored in the lid 120 of the toothbrush 110 and thus the cleaning solution can be discharged outside if the lid 120 is open due to the user's carelessness. Also, care should be taken for preventing loss of the cleaning solution stored in the lid 120 when using the toothbrush 110. Further, it is troublesome to repeat the motions of putting in and pulling out the toothbrush 110 in the lid 120 every time the user tries to soak the toothbrush 110 in the cleaning solution.

To solve the above problems, Korean Patent No. 10-0468075 titled "An interdental toothbrush provided with a cleaning solution" has been suggested. The interdental toothbrush disclosed in this patent comprises, as shown in FIG. 2, a case 40 having both ends opened, a storage tank 30 installed in the case 40, on one side of which is formed a discharge hole 32, and the other side of which is open, a pleated tube 70 coupled to the opened outer circumferential face of the storage tank 30 and to a check valve 80 joined to an end thereof, a spring 55 installed on the outer circumferential face of the discharge hole 32, a coupling socket 50 installed on the outer circumferential face of the discharge hole 32 and having a screw part on the outer circumferential face thereof, a nozzle 60 screw-coupled to the discharge hole 32, an end portion of which is split into upper and lower parts, and having a cone-shaped discharge hole inside and a slanted bump 62 on an outer circumferential face thereof, a fixing ring 65 coupled to the split outer circumferential face of the nozzle 60 and contacted with a side surface of the coupling socket 50, and a nozzle cap 90 engaged in the screw portion formed on the coupling socket 50 and having a brush 95 assembled on the front surface thereof and a couple of injection holes 92 formed therein. This interdental toothbrush is effective in eliminating the inconvenience of handling cleaning solution of the prior art, however, the structure is complicated and the manufacturing cost is high, so it is not practical. Further, when the cleaning solution is all used up, the storage tank 30 should be replenished with a new cleaning solution, however, it is impossible to replenish the cleaning solution in the storage tank 30, which makes it impossible to continuously use the interdental toothbrush purchased at a high price.

SUMMARY

It is an object of the present invention to solve the above-described problems encountered with the prior arts and to provide a portable interdental toothbrush capable of filling the cleaning solution after use, which enables long term use, simple structure, low manufacturing cost, and convenience in use.

The above objects the present invention is achieved by a portable interdental toothbrush according to the present invention comprising: a cleaning solution tube filled with a cleaning solution therein, and a cleaning body having a brush assembled to a discharge end of the cleaning solution tube and being wetted by the cleaning solution discharged through the discharge end, wherein: the cleaning solution tube is touted of a tube body filled with the cleaning solution and a discharge end discharging the cleaning solution which is extended from the tube body, an engaging portion is formed on a neck portion where the tube body and the discharge end meet with each, and a discharge slit for discharging the cleaning solution is formed on a tip of the discharge end, and the cleaning body is configured such that one end thereof is inserted in the discharge end to form an engaging protrusion for engaging with the engaging portion and, in the other end, an adhesion protrusion liar adhering closely to a discharge slit of the discharge end is formed in the inside surface and a communicating hole for communicating with the brush is formed on a tip.

A portable interdental toothbrush according to the present invention can be carried conveniently since a cleaning solution tube stays in a sealed state when carried without using it, which makes it convenient to use. When using the interdental toothbrush, an engaging protrusion fixed to an engaging portion is released to wet a brush with the cleaning solution filled in the cleaning solution tube through the discharge hole by pulling the brush body to use the interdental toothbrush, thereby the structure is simple, the production is easy, and production cost is low, thereby allowing any user to use it, which promotes the dental and oral health for citizens.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
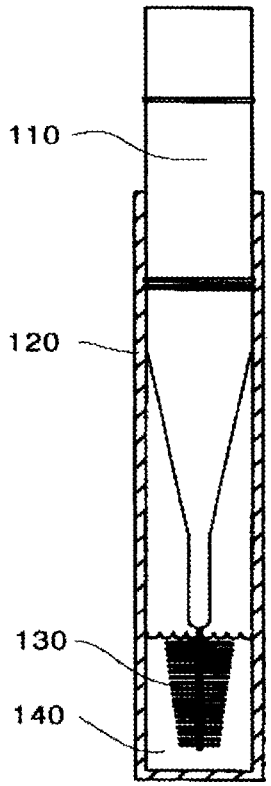
Prior Art Fig. 1
FIG. 1 is a longitudinal cross-sectional view of a conventional interdental toothbrush.
Figure 2:
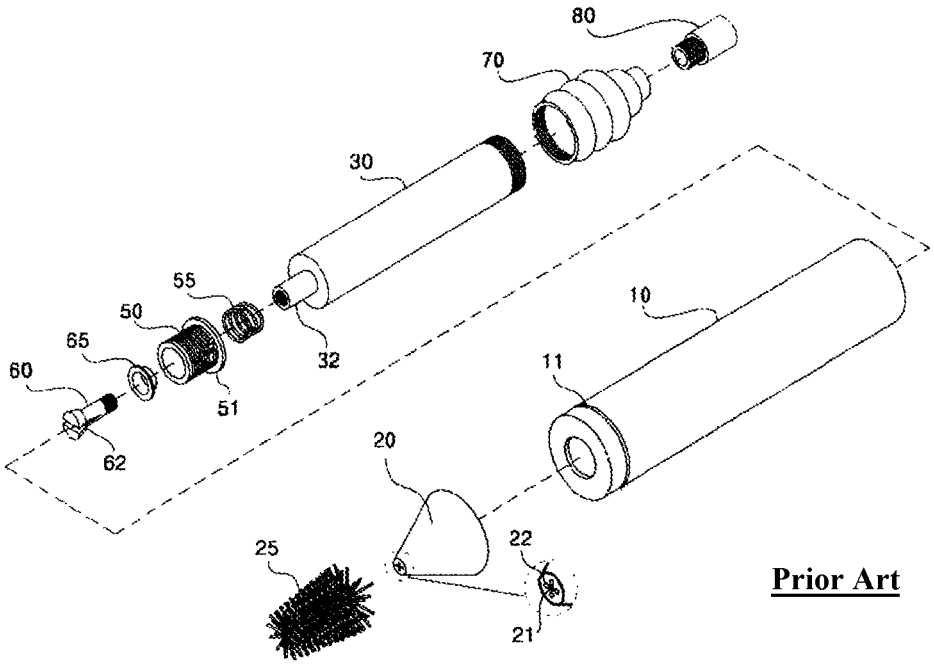
Prior Art Fig. 2
FIG. 2 is an exploded perspective view of another conventional interdental brush.

Hereinafter, the configuration and operation of preferred embodiments of the present invention will be described in detail with reference to the accompanying drawings. Here, in the case of assigning the reference numerals to the components of the drawings, it should be noted that, with respect to the same components, the same reference numerals are used even in different drawings.

Figure 3:
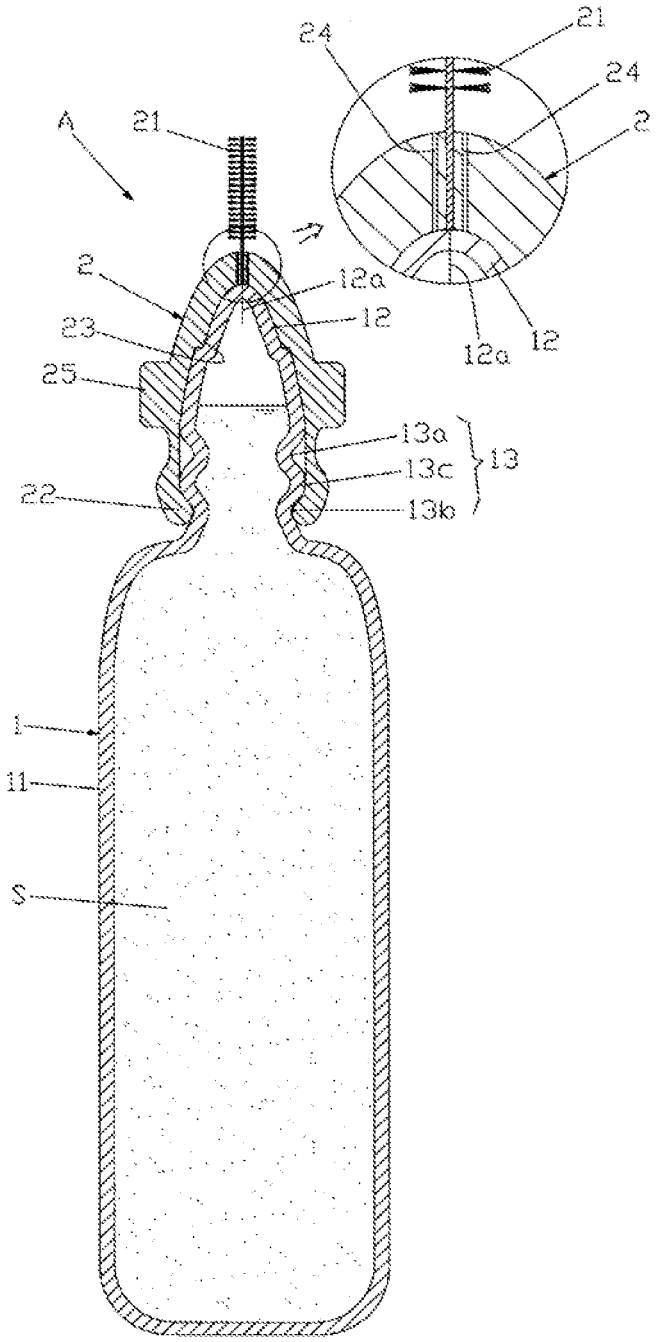
FIGS. 3 and 4 are a schematic longitudinal cross-sectional view and an operational view of a portable interdental toothbrush in accordance with the fast embodiment of the present invention.
Figure 4:
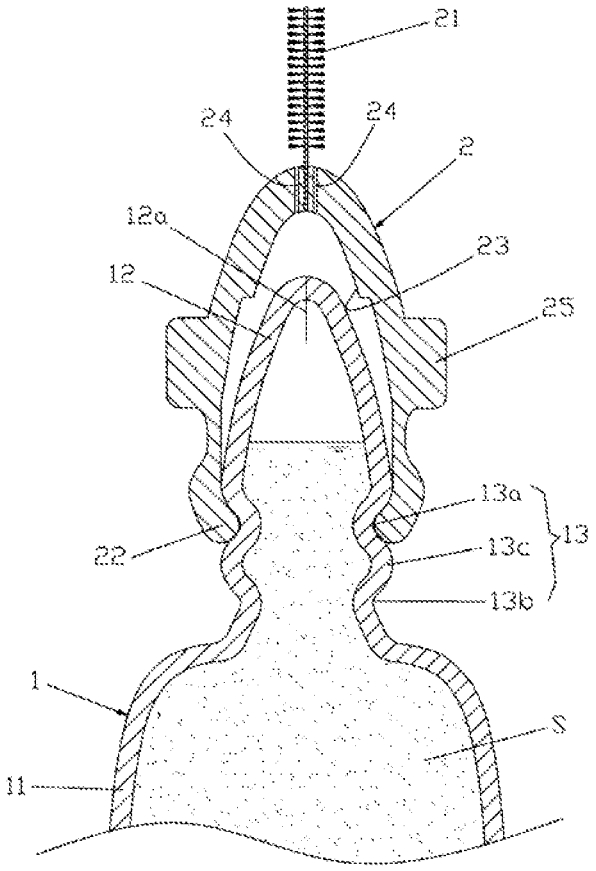

As shown in FIGS. 3 and 4, a portable interdental toothbrush A according to the first embodiment of the present invention comprises a cleaning solution tube 1 filled with a cleaning solution S containing fluoride therein, and a cleaning body 2 having a brush 21 assembled to a discharge end of the cleaning solution tube 1 and being wetted by the cleaning solution discharged through the discharge end.

The cleaning solution tube 1 is integrally formed of a tube body 11 filled with the cleaning solution and a discharge end 12 discharging the cleaning solution which is extended from the tube body 11. An engaging portion 13 is formed on a neck portion where the tube body 11 and discharge end 12 meet with each other, and a discharge slit 12*a* for discharging the cleaning solution is formed on a tip of the discharge end 12.

In the present embodiment, it is described that the discharge slit 12*a* incised thinly is formed on the tip of the discharge end 12. However, a discharge hole instead of the discharge slit may be formed, and to correspond thereto a protrusion for closing the discharge hole instead of the adhesion protrusion may be formed on the inside surface of the cleaning body 2.

In the present embodiment, the engaging portion 13 is formed integrally with the cleaning solution tube but it is not limited thereto. Rather, it is possible to form a separate engaging portion having an engaging groove and attach it to the cylindrical neck portion.

The cleaning solution tube 1 is preferably made of elastic synthetic resins or rubber such that the cleaning solution is discharged upon pressing.

An engaging protrusion 22 for engaging with the engaging portion 13 is formed on one end in which the discharge end 12 is inserted and an adhesion protrusion 23 for adhering closely to a discharge slit 12*a* of the discharge end 12 on an inside surface and a communicating hole 24 for communicating with the brush 21 on a tip are formed on the other end of the cleaning body 2.

The cleaning body 2 is preferably made of thermoplastic elastomer, which has preferable characteristics of both softness and elasticity and is processed by an injection molding, Natural rubber, synthetic rubber, or various materials of sponge type having such softness and elasticity may be used as well.

A pressing protrusion 25 is formed outside the cleaning body 2 to facilitate the forward and backward operations of the cleaning body 2.

The engaging portion 13 of the cleaning solution tube 1 includes an upper engaging groove 13*a* and a lower engaging groove 13*b*, if the engaging protrusion 22 of the cleaning body 2 is placed in the lower engaging groove 13*b*, the cleaning solution is prevented from discharging since the inside surface of the cleaning body 2 is closely adhered to the tip of the discharge end 12 to press the discharge slit 12*a*, and, if the engaging protrusion 22 of the cleaning body is placed in the upper engaging groove 13*a*, the cleaning solution is discharged since the inside surface of the cleaning body 2 becomes distant from the tip of the discharge end 12 to release a pressure on the discharge slit 12*a* to open the discharge slit 12*a*.

The operation of the portable interdental toothbrush A in accordance with the first embodiment according to the present invention having the above configuration will be described below. When the interdental toothbrush is not used, the engaging protrusion 22 of the cleaning body 2 is engaged with the lower engaging groove 13*b* of the cleaning solution tube 1, which prevents the cleaning solution from discharging. When it is used, the cleaning body 2 assembled to the cleaning solution tube 1 is lifted up through the pressing protrusion which moves the engaging protrusion 22 of the cleaning body 2 up to press a protruded peak 13*c* between the upper engaging groove 13*a* and the lower engaging groove 13*b*. Then, the protruded peak 13*c* moves down to make the engaging protrusion 22 to reach the upper engaging groove 13*a*, which changes the state of the adhesion protrusion 23 on the inside surface of the cleaning body 2 to the discharge slit 12*a* of the discharge end 12 from closely adhering to being apart. Now, the discharge slit 12*a* splits open to discharge the cleaning solution through the discharge slit 12*a*, and the cleaning solution is supplied to the brush 21 through the communicating hole 24 by inclining the interdental toothbrush A, which makes the interdental toothbrush A to brush teeth with the cleaning solution supplied to the brush 21.

Further, if it is pressed downward via the pressing protrusion 25 of the cleaning body 2 after use, the engaging protrusion 22 of the cleaning body 2 moves down to press the protruded peak 13*c*. The protruded peak 13*c* descends to make the engaging protrusion 22 to reach the lower engaging groove 13*b*. At the same time, the adhesion protrusion 23 of the cleaning body 2 adheres closely to the discharge slit 12*a* of the discharge end 12 to close the discharge slit 12*a*, which prevents the cleaning solution from discharging. Accordingly, it can be carried portably.

Figure 5:
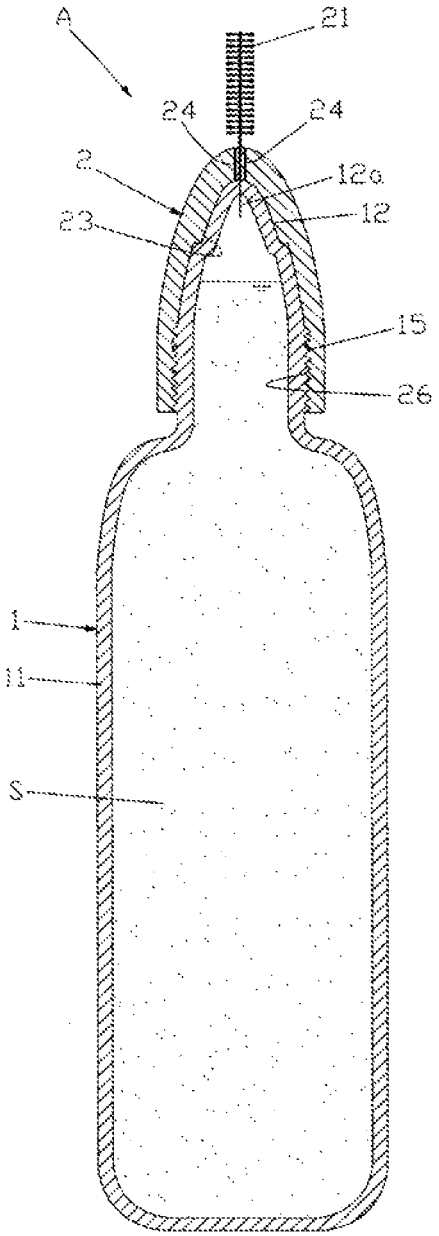
FIGS. 5 and 6 are a schematic longitudinal cross-sectional view and an operational view of a portable interdental toothbrush in accordance with the second embodiment of the present invention.
Figure 6:
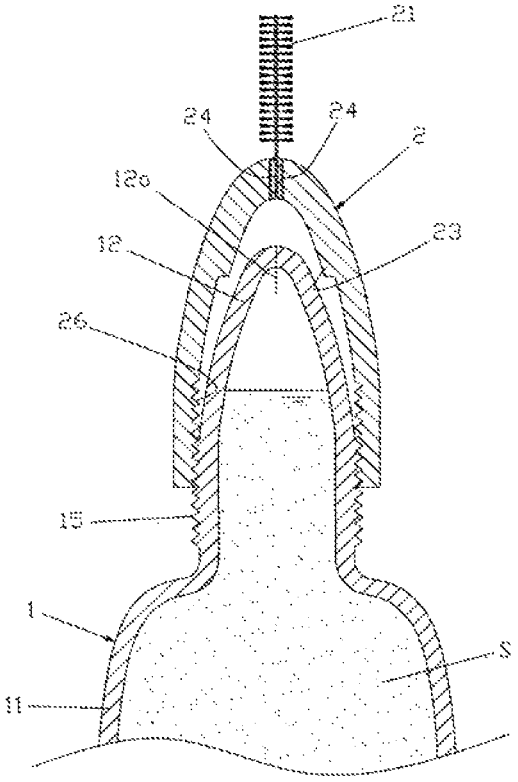

As shown in FIGS. 5 and 6, a portable interdental toothbrush A according to the second embodiment of the present invention comprises a cleaning solution tube 1 filled with a cleaning solution S containing fluoride therein, and a cleaning body 2 having a brush 21 assembled to a discharge end of the cleaning solution tube 1 and being damped by the cleaning solution discharged through the discharge end.

A tube body 11 filled with the cleaning solution and the discharge end 12 extended from the tube body 11 for discharging the cleaning solution are integrated in a single body to form the cleaning solution tube 1. An assembly screw 15 is formed on a neck portion where the tube body 11 and discharge end 12 meet with each other, and a discharge slit 12*a* for discharging the cleaning solution is formed on a tip of the discharge end 12.

The cleaning solution tube 1 is preferably made of elastic synthetic resins or rubber such that the cleaning solution is discharged upon pressing.

A negative screw portion 26 for assembly with the assembly screw 15 is formed on one end in which the discharge end 12 is inserted and an adhesion protrusion 23 for adhering closely to a discharge slit 12*a* of the discharge end 12 on an inside surface and a communicating hole 24 for communicating with the brush 21 on a tip are formed on the other end of the cleaning body 2.

The assembly screw 15 of the cleaning solution tube 1 is assembled with the negative screw portion 26 of the cleaning body 2, in a state where screw-coupling of the negative screw portion 26 of the cleaning body 2 is completely assembled, the cleaning solution is prevented from discharging since the adhesion protrusion 23 on the inside surface of the cleaning body 2 is closely adhered to the tip of the discharge end 12 to press the discharge slit 12*a*, and, if the cleaning body 2 is rotated and the cleaning body 2 is moved upward, the cleaning solution is discharged since the adhesion protrusion 23 on the inside surface of the cleaning body 2 becomes distant from the tip of the discharge end 12 to release a pressure on the discharge slit 12*a* to open the discharge slit 12*a*.

The operation of the portable interdental toothbrush A in accordance with the second embodiment according to the present invention having the above configuration is described below. When it is not used, screw-coupling of the assembly screw 15 and the negative screw portion 26 of the cleaning solution tube 1 and the cleaning body 2 is completed, which presents the cleaning solution from discharging. When using, the cleaning body 2 screw-coupled to the cleaning solution tube 1 is rotated to fill up the cleaning body 2, which changes the state of the adhesion protrusion 23 on inside surface of the cleaning body 2 to the discharge slit 12*a* of the discharge end 12 from closely adhering to being apart. Now, the discharge slit 12*a* splits open to discharge the cleaning solution through the discharge slit 12*a*, and the cleaning solution is supplied to the brush 21 through the communicating hole 24 by inclining the interdental toothbrush A, which makes the interdental toothbrush A to brush teeth with the cleaning solution supplied to the brush 21.

Further, if the cleaning body 2 is rotated in an opposite direction after use, the cleaning body 2 descends to make the adhesion protrusion 23 of the cleaning body 2 to adhere closely to the discharge slit 12*a* of the discharge end 12 to close the discharge slit 12*a*, which prevents the cleaning solution from discharging. Accordingly, it can be carried portably.

It is possible to manufacture the same products as the portable interdental toothbrush in accordance with the present invention repeatedly in the manufacturing field of the interdental toothbrush. Accordingly, the present invention possesses industrial applicability.

Although the specific embodiments of the present invention have been disclosed for illustrative purposes, those skilled in the art will appreciate that various modifications, additions and substitutions may be made to the invention without, departing from the scope and spirit of the invention as disclosed in the accompanying claims.

What is claimed is:

1. A portable interdental toothbrush (A) comprising:

a cleaning solution tube (1) filled with a cleaning solution (S) therein and a cleaning body (2) having a brush (21) assembled to a discharge end of the cleaning solution tube (1) and being wetted by the cleaning solution discharged through the discharge end, wherein:

the cleaning solution tube (1) is formed of a tube body (11) filled with the cleaning solution and a discharge end (12) discharging the cleaning solution which is extended from the tube body (11), an engaging portion (13) is integrally formed on a neck portion where the tube body (11) and the discharge end (12) meet with each other, and a discharge slit (12*a*) for discharging the cleaning solution is formed on a tip of the discharge end (12), and the cleaning body (2) is configured such that one end thereof is inserted in the discharge end (12) to form an engaging protrusion (22) for engaging with the engaging portion (13) and, in the other end, an adhesion protrusion (23) for adhering closely to a discharge slit (12*a*) of the discharge end (12) is formed in the inside surface and a communicating hole (24) for communicating with the brush (21) is formed on a tip.

2. The portable interdental toothbrush (A) comprising:

a cleaning solution tube (1) filled with a cleaning solution therein, and a cleaning body (2) having a brush (21) assembled to a discharge end of the cleaning solution tube (1) and being wetted by the cleaning solution discharged through the discharge end, wherein the cleaning solution tube (1) is integrally formed of a tube body (11) filled with the cleaning solution and a discharge end (12) discharging the cleaning solution which is extended from the tube body (11), an assembly screw (15) is formed on a neck portion where the tube body (11) and discharge end (12) meet with each other, a discharge slit (12*a*) for discharging the cleaning solution is formed on a tip of the discharge end (12), and the cleaning body (2) is configured such that one end thereof is inserted in the discharge end (12) to form a negative screw portion (26) for assembly with the assembly screw (15) and, in the other end, an adhesion protrusion (23) for adhering closely to a discharge slit (12*a*) of the discharge end (12) is formed on the inside surface and a communicating hole (24) for communicating with the brush (21) is formed on a tip.

3. The portable interdental toothbrush of claim 1, wherein the engaging portion (13) of the cleaning solution tube (1) includes an upper engaging groove (13*a*) and a lower engaging groove (13*b*); if the engaging protrusion (22) of the cleaning body (2) is placed in the lower engaging groove (13*b*), the cleaning solution is prevented from discharging since the inside surface of the cleaning body (2) is closely adhered to the tip of the discharge end (12) to press the discharge slit (12*a*), and, if the engaging protrusion (22) of the cleaning body is placed in the upper engaging groove (13*a*), the cleaning solution is discharged since the inside surface of the cleaning body (2) becomes distant from the tip of the discharge end (12) to release a pressure on the discharge slit (12*a*) to open the discharge slit (12*a*).

4. The portable interdental toothbrush of claim 2, wherein the assembly screw (15) of the cleaning solution tube (1) is assembled with the negative screw portion (26) of the cleaning body (2), in a state where screw-coupling of the negative screw portion (26) of the cleaning body (2) is completely assembled, the cleaning solution is prevented from discharging since the inside surface of the cleaning body (2) is closely adhered to the tip of the discharge end (12) to press the discharge slit (12*a*), and, if the cleaning body (2) is rotated and the cleaning body (2) is moved upward, the cleaning solution is discharged since the inside surface of the cleaning body (2) becomes distant from the tip of the discharge end (12) to release a pressure on the discharge slit (12*a*) to open the discharge slit (12*a*).

* * * * *